United States Patent [19]

Vitol

[11] Patent Number: 4,671,003

[45] Date of Patent: Jun. 9, 1987

[54] EASY REMOVAL LABEL AND METHOD FOR PRODUCING SAME

[76] Inventor: Matt J. Vitol, 146 East Court St., Woodstock, Va. 22664

[21] Appl. No.: 768,477

[22] Filed: Aug. 22, 1985

[51] Int. Cl.[4] ..... A44C 3/00

[52] U.S. Cl. ..... 40/2 R; 428/191; 156/289

[58] Field of Search ..... 40/2 R, 19.5; 428/191, 428/198, 195, 201; 156/278, 289, 291; 215/DIG. 2; 118/221

[56] References Cited

U.S. PATENT DOCUMENTS

| | | | |
|---|---|---|---|
| 1,619,081 | 3/1927 | McLaurin | 428/191 |
| 1,634,251 | 7/1927 | Aronson | 40/2 R |
| 1,926,553 | 9/1933 | Morse | 40/2 R |
| 2,095,437 | 10/1937 | Fox | 40/2 R |
| 2,170,147 | 8/1939 | Lane | 40/2 R |
| 2,341,583 | 2/1944 | Tuve | 428/191 X |
| 2,541,631 | 2/1951 | Baskin | 156/289 X |
| 2,636,297 | 4/1953 | Johnson | 40/2 R |
| 2,648,924 | 8/1953 | Brewster | 40/2 R |
| 3,077,683 | 2/1963 | Jones | 40/2 R |
| 3,125,465 | 3/1964 | Kuts | 152/289 X |
| 3,377,184 | 4/1968 | Kukoff | 428/201 |
| 3,706,626 | 12/1972 | Smith et al. | 40/2 R |
| 3,799,829 | 3/1974 | Heatwole | 40/2 R |
| 3,892,901 | 7/1975 | Smith | 40/2 R |
| 3,974,311 | 8/1976 | Cherrin | 40/2 R |
| 4,059,912 | 11/1977 | Noah | 40/2 R |
| 4,159,586 | 7/1979 | Blum | 40/2 R |
| 4,214,024 | 7/1980 | Jacobson | 40/2 R |
| 4,557,505 | 12/1985 | Schaefer et al. | 428/195 |

FOREIGN PATENT DOCUMENTS

| | | | |
|---|---|---|---|
| 31305 | 12/1969 | Japan | 40/19.5 |

*Primary Examiner*—John J. Wilson
*Assistant Examiner*—J. Hakomaki
*Attorney, Agent, or Firm*—Sixbey, Friedman & Leedom

[57] ABSTRACT

A pressure-sensitive adhesive backed information-conveying sign which is readily removable and reusable is provided. The sign includes an adhesive-free zone contained entirely within the perimeter of the sign which may be readily grasped with the fingers to remove the sign from the surface to which it has been applied. A method for producing a pressure-sensitive adhesive sign containing such an adhesive-free zone which may be adapted to modify conventional laminate production line procedures is also provided.

9 Claims, 7 Drawing Figures

EASY REMOVAL LABEL AND METHOD FOR PRODUCING SAME

TECHNICAL FIELD

The present invention relates generally to signs, labels and other unitary identifying indicia and specifically to an easily removable and reusable pressure-sensitive adhesive sign and to a method for producing an easily removable and readily reusable pressure-sensitive adhesive sign.

BACKGROUND ART

Signs, labels, tags and similar identifying indicia of the type which are customarily applied to a surface with pressure sensitive adhesive are being used in increasing numbers by government, industry and private enterprise. Every year, or more frequently, state and local governments issue millions of pressure sensitive labels and tags which are required to be applied to automobiles, boats and other vehicles to evidence payment of registration fees, taxes and the like. The label or tag or "sticker" as it is more commonly known must be replaced annually or every time the tax or fee is paid. In some situations, for example in states which allow but heavily regulate gambling, stickers showing the payment of the requisite monthly taxes or fees must be prominantly displayed on devices like slot machines. Other pressure sensitive signs or labels are increasingly being used to impart a wide variety of information from the name of the manufacturer of a product, to instructions for product use, or to the fact that a motor vehicle or other item has been inspected or approved and to whatever message the buyer desires to put on his or her car bumper. The widespread use of such pressure sensitive labels, signs and tags, primarily because of their low cost, is expected to increase to an even greater extent.

The application of pressure-sensitive indicia is generally accomplished with ease although removal from the carrier or backing paper can pose problems. However, when the time comes to remove last year's vehicle registration sticker or last month's weighing scale approval tag or the unwanted bumper sticker, removal is generally only accomplished with great difficulty. Removal of these stickers with the fingers is virtually impossible. Although a razor blade, knife or scraper will usually remove the old sticker, removal in this manner is more often than not accompanied by damage to the surface from which the sticker is being removed, the remover, or both. Moreover, if removal has been attempted with the fingernails, the remover will be left with broken or split fingernails as well as a feeling of extreme frustration. In addition, it is highly unlikely that a sticker removed in this way would ever be able to be reused, if such was desired or required. Since there are instances in which the transfer of the information represented by a tag, label, sign or other sticker from one surface to another is necessary, the provision of means which would facilitate removal of the sign for reuse would be highly desirable.

The pressure sensitive adhesive signs, labels and tags disclosed in the prior art are not intended to be easily removed and then reused. Moreover, those prior art signs including means to facilitate their removal from the surface to which they have been applied employ tabs or other protuberances that extend beyond the perimeter of the sign. While these structures do assist in sign removal, the excess material required to produce such tabs results in inefficiencies, wasted material and, hence, increased cost in the production of signs including them. Moreover, these tabs or projections are susceptible of tearing, particularly on a sign intended for repeated reuse.

U.S. Pat. No. 3,421,239 to Smith discloses a circular marker or tag including an adhesive-free tab which extends outwardly of the main body of the tag to assist in removing the tag from its backing paper. The adhesive-free tab area results from the pattern of adhesive application to the back of a sheet containing a plurality of such tags. Not only do the tags disclosed in the Smith reference suffer from the aforementioned disadvantages, but they are also clearly intended only for one-time use and are not intended to be removable or reusable once they have been applied.

U.S. Pat. No. 3,914,483 to Stipek discloses a multiple part label for use on a package or container including inner removable label portions which may be provided with one or more adhesive-free edges to assist in the removal of the inner label from its backing sheet. However, there is no suggestion that once the Stipek label has been removed from its backing sheet and applied to the surface of a package or container that the adhesive-free area has any further utility, particularly since the label described in this reference is not contemplated to be removed and reused. There is, moreover, no disclosure in the Stipek patent of specifically how the adhesive-free area of the label is created.

U.S. Pat. Nos. 2,013,299 to Byrne and 4,201,403 to Turner disclose, respectively, seals and tabs having adhesive-free portions. Neither of these devices, however, is intended to employ the adhesive-free portions disclosed therein to facilitate removal of the device from the surface to which it has been applied so that it may be reapplied to another surface and reused, if desired.

A sticker contemplated for temporary application is disclosed in U.S. Pat. No. 4,055,249 to Kojima. This sticker, however, is formed of a complex, multi-layer arrangement of sticking sheets specially cut to form lugs or tabs which project beyond the body of the sticker to provide a structure which can be grasped with the fingers to remove the sticker. Additionally, a series of several manufacturing steps is required to form this multilayer arrangement. There is, moreover, no suggestion that the potentially costly sticker unit described in this reference is intended to be reused once it has been removed from the surface to which it has been applied.

Consequently, the prior art has failed to disclose a sign, label, tag or the like which is rendered efficiently and effectively removable and potentially reusable by the provision of an integral, self-contained adhesive-free area located completely within the perimeter of the sign or a simple, inexpensive method for producing a readily removable and reusable sign, label, tag or sticker containing such an adhesive-free area.

SUMMARY OF THE INVENTION

It is, therefore, a primary object of the present invention to provide a pressure-sensitive adhesive-backed reusable sign which includes an integral, self-contained easily identified adhesive-free portion located completely within the perimeter of the sign whereby the sign may be easily removed from the surface to which it has been applied and readily reapplied to another surface, if desired.

It is another object of the present invention to provide a readily removable and repeatedly reusable sign which may be located on either an exterior or an interior surface.

It is yet another object of the present invention to provide a method for producing a readily removable and repeatedly reusable pressure sensitive adhesive backed sign including the creation of an adhesive-free zone which is completely contained within the perimeter of the sign.

It is still another object of the present invention to provide a method for producing an easily removable, potentially reusable pressure sensitive adhesive backed sign which minimizes material waste.

It is a further object of the present invention to provide a low-cost, efficient method for producing an easily removable, potentially reusable pressure sensitive adhesive backed sign which may be employed with only minimal modification of existing production line equipment.

The present invention provides a readily removable sign or label which may be temporarily applied to a surface, removed easily from that surface and subsequently reapplied to other surfaces. The sign of the present invention includes a sheet which has a first, information-receiving surface and a second, adhesive receiving surface opposite the first surface. An adhesive-free zone located completely within the outer perimeter of the sign is provided on the second surface to form finger grip means. The second, adhesive-receiving surface is laminated to a release-coated backing paper. Optional identifying indicia may be applied to the first surface to mark the location of the adhesive-free zone and thereby assist users of the sign to locate the adhesive-free zone prior to removal of the sign.

The present invention additionally provides a method for producing a readily removable and potentially reusable sign having a first, information-receiving surface and a second, adhesive-receiving surface and including an adhesive-free zone positioned within the perimeter of the zone to form finger grip means. The method of the present invention includes the steps of providing a first sheet having at least one surface characterized by low adhesion, perforating the first sheet at a plurality of predetermined points to form a predetermined pattern of perforations, providing a second sheet including a first, information-receiving surface and a second, adhesive-receiving surface, applying a pressure sensitive adhesive to the adhesive-receiving surface of the second sheet, laminating the low adhesion surface of the perforated first sheet to the second surface of the second sheet to create a laminate having a plurality of exposed adhesive zones, neutralizing the adhesive on the second surface in the area of the perforations to create a plurality of adhesive-free zones, optionally applying information to the information-receiving surface of the second sheet, and cutting the laminated first and second sheets according to a predetermined pattern to form a plurality of signs, each of which includes an adhesive-free zone within the perimeter thereof.

Other objects and advantages will be apparent from the following descripton, claims and drawing.

BEST MODE FOR CARRYING OUT THE INVENTION

The proliferation of information-conveying signs or labels which include a pressure-sensitive adhesive layer to enable the temporary or substantially permanent application of these signs to a variety of surfaces has created a need for a way to remove the signs easily so that they can be reused or replaced with additional information-conveying signs. The present invention provides both an easily removable and reusable pressure-sensitive adhesive backed sign and a method for producing such an easily removable and reusable sign. The signs contemplated by the present invention will take a variety of forms, and the examples discussed herein are intended to be illustrative and are not intended to be limiting in any way. Additionally, although the term "sign" is used throughout to designate the information-conveying medium with which the present invention is employed, the term "sign" is intended to include labels, tags, "stickers", "bumper stickers" and similar information-conveying media.

Figure 1:
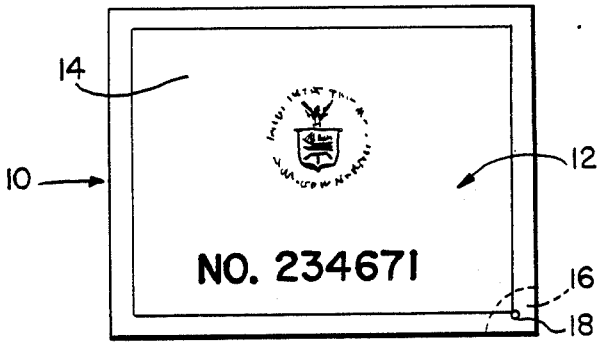
FIG. 1 is a top view of one embodiment of removable and reusable sign of the present invention.

Referring to the drawings, FIG. 1 illustrates, in top view, one embodiment of a sign 10 manufactured in accordance with the present invention. The sign 10 has a generally rectangular configuration, although any geometric or irregular shape desired may be employed. The selection of a regular, geometric configuration, however, substantially reduces material waste during production and, therefore, reduces the cost of each sign. Identifying indicia or information 12 are shown printed on the top surface 14 of the sign 10. The opposite lower surface, as will be described in more detail hereinbelow, includes a layer of pressure-sensitive adhesive which covers the entire lower surface of the sign except for an adhesive-free area or zone 16 indicated by the dashed outline in the lower right corner of sign 10. A marker 18 is optionally provided within the adhesive-free zone 16 to assist in locating the position of the zone. The marker 18 may take a variety of forms. It is preferred to use a hole having a diameter of about 1/64 inch, such as would be made by a punch. A marker of this type is sufficiently small and unobtrusive that it does not interfere with the information contained on the sign, but can still be seen by the person who must remove the sign.

The exact size and location of the adhesive-free zone 16 will depend in large measure upon the shape and the size of the sign 10. The most effective location of zone 16 on a rectangular sign has been found to be at one of the four corners. The size or area of zone 16 relative to the area of the sign does not have to be very large and, in some applications, should be as small as possible. A sufficiently large adhesive-free zone must be provided to enable the person removing the sign to grasp the edge of the sign with the fingers and pull it away from the surface on which it has been applied. The adhesive-free zone 16 is located completely within the outside perimeter of the sign 10 and would also be located completely within the perimeter of a sign having a circular configuration. The adhesive-free zone for a circular sign may be of any effective configuration, however, a wedge-shaped area has been found to work well.

Figure 2:
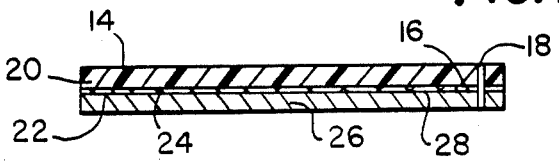
FIG. 2 is a cross-sectional view of the sign of FIG. 1.

FIG. 2 illustrates the sign 10 of FIG. 1 in cross-section, where it can be seen that sign 10 includes multiple layers. Sign 10 includes a film or sheet 20 having a top surface 14, which receives information such as that displayed at 12 in FIG. 1, and a bottom surface 22, which receives a layer 24 of a pressure-sensitive adhesive. The adhesive layer 24 covers all of surface 22 except for zone 16, which is adhesive-free. Until the sign 10 is actually applied to its intended surface, the pressure-sensitive adhesive is protected by a backing sheet 26. The surface 28 of the backing sheet 26 which covers adhesive layer 24 is provided with a release-type coating (not shown), such as silicone, so that this surface is characterized by low adhesion, and the sign 10 may be readily removed from the backing sheet 26. The marker 18, which locates the adhesive-free area, will assist the user of the sign in locating the adhesive-free zone 16 and removing the sign from the backing sheet 26.

Figure 3:
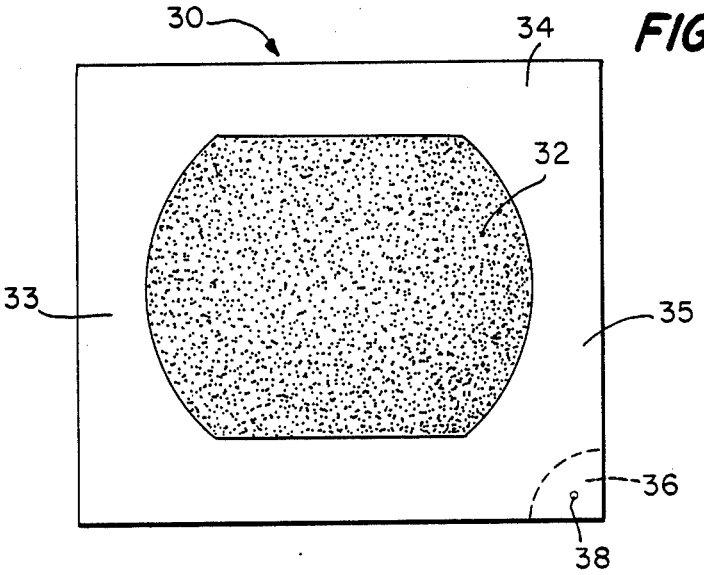
FIG. 3 is a top view of a second embodiment of removable and reusable sign of the present invention.
Figure 4:
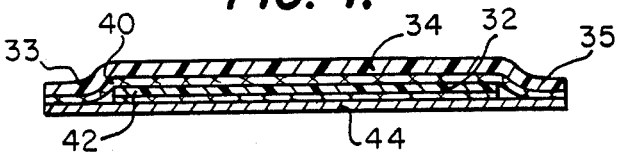
FIG. 4 is a cross-sectional view of the sign of FIG. 3.

FIG. 3 illustrates a second embodiment of the present invention in top view, and FIG. 4 illustrates this embodiment in cross-section. The sign 30 of this embodiment is particularly well-suited for application to an exterior surface such as an automobile windshield. Sign 30 includes a central signal portion 32 which is covered by a transparent protective film 34. Film 34 extends beyond the perimeter of signal portion 32 to areas 33 and 35 in the sign 30 shown in in FIG. 3 and includes a backing layer of pressure-sensitive adhesive. However, the film 34 could be coextensive with the signal portion 32. This arrangement permits the exterior use of a material for signal portion 32 which might not otherwise be able to withstand adverse environmental conditions. The shape of signal portion 32 can be the unusual elliptical configuration shown in FIG. 3 or any other shape desired. As will be explained in more detail hereinbelow in connection with FIG. 7, one anticipated use of a sign of this embodiment is to provide a marker which can be easily seen and identified from a distance. Consequently, any shape which achieves this objective can be utilized. Since the film portion 34 is rectangular, an adhesive-free zone 36 is positioned at a corner of the rectangle. A marker 38 identifies the location of the adhesive-free zone 36.

FIG. 4 shows the multiple layer construction of sign 30 as it would appear in cross-section at approximately the center of the sign. Film 34 includes a layer 40 of pressure-sensitive adhesive. Disposed below adhesive layer 40 is the central signal portion 32, which also includes a layer 42 of a pressure-sensitive adhesive. The entire assembly is preferably held on a backing sheet 44 until application to a surface is desired. The backing sheet 44 preferably includes a release coating (not shown) so that the sign 30 can be easily removed from the backing sheet and replaced on the backing sheet, if desired.

The signs of the present invention can be made from a variety of materials. Plastic films, such as MYLAR® (polyester), polyvinylchloride, acetate, methylmethacrylate and polycarbonate, are particularly suitable for use in the present invention. They can be transparent or colored, and the surfaces of these films will accept both printing and the application of a pressure-sensitive adhesive. Suitable backing papers which may be laminated to such adhesive-backed films to protect the adhesive prior to application of signs formed from these films are known in the laminating art. Any suitable film or backing paper which achieves the objectives sought by the present invention could be used to form the easily removable and reusable signs described herein. Both sheet 20 of sign 10 of FIG. 1 and the central signal portion 32 of sign 30 of FIG. 3 could, in addition, be made from paper, lightweight paperboard or the like to which a layer of pressure-sensitive adhesive has been applied.

There are available many pressure-sensitive adhesives which could be employed to form the easily removable sign of the present invention. The specific adhesive selected will depend, in part, upon whether the sign is intended for reuse or reapplication.

The present invention further includes a method for producing the readily removable signs described above. The creation of an adhesive-free zone on each sign like zone 16 (FIG. 1) and zone 36 (FIG. 3) and the mass production of a large number of adhesive-backed signs laminated to a backing sheet is efficiently achieved according to the method of the present invention. This method is described with reference to FIGS. 5 and 6.

Figure 5:
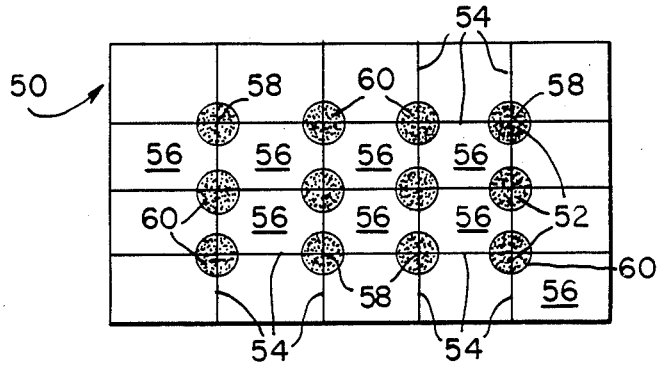
FIG. 5 is a top view of a backing sheet perforated according to the method of the present invention.

Pressure-sensitive product laminates typically consist of a film that is coated with a suitable pressure-sensitive adhesive and a backing or laminate sheet which is generally paper and one side of which is characterized by low adhesive attraction. Often a release-type coating, such as silicone, is applied to the backing paper to achieve the low adhesion characteristics. FIG. 5 illustrates such a backing or laminate sheet 50. The backing sheet 50 is perforated at a plurality of regular intervals. The size, spacing and location of perforations 52 will vary, depending upon the ultimate configuration and size chosen for the signs to be produced. A circular or elliptical perforation is preferred, however. For purposes of illustration, the present method will be described as it relates to the production of a rectangular sign, such as that shown in FIG. 1. The same method may be effectively employed to produce a circular, elliptical or even a pretzel-shaped sign. This method, moreover, can be adapted easily to large or small scale production equipment. In the production of a sign of rectangular configuration, the backing sheet 50 can be marked with a series of intersecting parallel lines, such as lines 54 forming the grid shown in FIG. 5. The rectangular areas 56 outlined by the lines 54 correspond to the ultimate dimensions of the plurality of signs which may be obtained from each sheet. It will be apparent that the production of a rectangular sign results in the least waste of material; however, the production of other shapes of removable signs according to this process also results in less waste than do prior art processes.

Perforations 52 are positioned substantially symmetrically about the point of intersection 58 of four adjacent rectangles 56 so that each perforation 52 removes a portion of the corner 60 of each rectangle 56. The perforations 52 may be made in the backing sheet 50 on conventional high speed machinery currently employed for perforating business forms, paper towels and the like.

Figure 6:
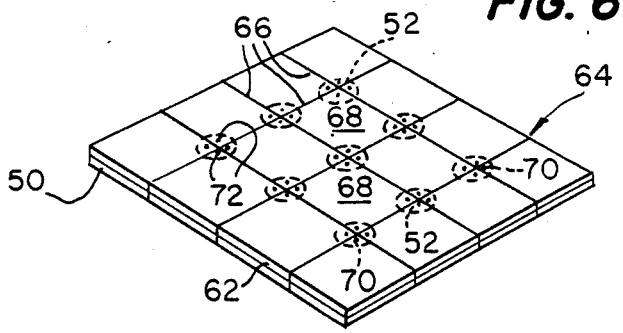
FIG. 6 is a top perspective view of a perforated backing sheet and an adhesive-receiving sheet laminated according to the present invention and including a plurality of signs of a single configuration.

One surface of the plastic film, paper or other material 62 from which the sign is to be made is coated with pressure-sensitive adhesive appropriate for the ultimate application of the sign according to conventional methods which are well known in the art, and the backing sheet 50, perforated as described, is then laminated to the adhesive-coated film 62 to form the laminate 64 shown in FIG. 6. Perforations 52, indicated in dashed lines in FIG. 6, do not extend through the film 62, but expose areas of the adhesive-coated surface of film 62.

Following the lamination of backing sheet 50 to the adhesive-coated film 62, the laminate is subjected to an adhesive neutralization step, whereby the adhesive-containing areas on film 62 which are exposed by the perforations 52 in the backing sheet 50 are treated to render them adhesive-free. A particularly effective and efficient way to achieve this objective is to apply an adhesive-neutralizing material to the backing sheet side of the laminate 64 so that the adhesive-neutralizing material contacts the adhesive on film 62 in the area of each perforation 52. Any material capable of neutralizing the adhesive coated on film 62 may be used for this purpose. A dry powder is the preferred form for the adhesive-neutralizing material. One particularly effective adhesive-neutralizing material, which is also very low in cost, is powdered talc, a readily available inexpensive form of magnesium silicate. The talc can be easily applied to the perforations on the backing sheet by a variety of methods, such as, for example, dusting by means of inpregnated pads, by rollers, by the application of controlled puffs of talc or by wipe on—wipe off techniques. Other, similar, adhesive-neutralizing materials, such as silica or pulverized charcoal, may also be employed. However, any material which could be used in the process described herein to effectively neutralize the adhesive in a pressure-sensitive laminate is contemplated for use with the present invention. Moreover, the addition of the described adhesive-neutralizing step to conventional laminating proceses can be achieved with only minimal changes in production line equipment.

The application of the talc or other suitable material creates a plurality of adhesive-free areas or zones which are defined by the circumferences of perforations 52 on the adhesive-coated surface of sheet 62. When the laminate 64 is cut along lines 66 to form a plurality of rectangular signs 68 as shown in FIG. 6, each rectangle has an adhesive-free zone 70 in one corner. Adhesive-free zone 70 in FIG. 6 corresponds to the adhesive-free zone 16 of sign 10 in FIG. 1. The adhesive-free zone thus created provides a lifting point for the finished sign which will remain adhesive-free for the life of the sign. The adhesive-free zone serves not only to assist the user in removing the sign from its backing paper and to place it in the exact location selected, but also to aid the user in removing the sign from that location with relative ease and without tools.

Prior to cutting the laminate sheet 64 into individual signs 68, the sheet may be printed by silk-screening or other suitable processes so that each sign contains whatever information, identifying indicia or the like desired. Also, prior to cutting the laminate sheet 64 into individual signs, a suitable marker may be applied to the sheet to mark the precise location of the adhesive-free zone 70 on each sign. This may be accomplished by punching the laminate at points 72 in FIG. 6. A punch which leaves a hole about 1/64 inch in diameter has been found to be especially suitable for this purpose. The arrangement shown in FIG. 6 lends itself particularly well to the use of a machine tool which includes four such punches to punch simultaneously markers 72 in the adhesive-free zones 70 of four signs 68. The markers 72 in FIG. 6 correspond to marker 18 in FIG. 1. If film 62 is transparent or light in color, the adhesive-free area 70 may be simultaneously created and marked by using talc which has been tinted or a naturally dark adhesive-neutralizing material, such as pulverized charcoal.

The printed and punched laminate sheet 64 is then cut along lines 66 to form the finished signs 68. The number of signs which can be obtained from each laminate sheet, such as sheet 64, will depend upon such factors as the size of the laminate sheet and the size and configuration of the finished signs printed on the sheet.

The production of the sign embodiment shown in FIGS. 3 and 4 will be similar to that just described. An additional laminating step would be required, preferably after the printing step, to laminate a transparent film to the upper surface of the laminate sheet 64 so that the printed signs will be protected when they are applied to exterior surfaces.

Figure 7:
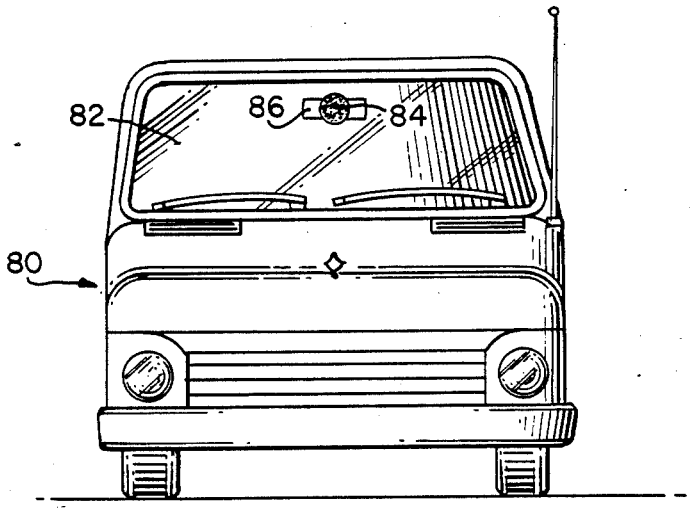
FIG. 7 illustrates one end use of the present invention.

FIG. 7 illustrates one use for which the removable and reusable pressure-sensitive adhesive sign of the present invention is especially suited. A motor vehicle or automobile 80 is shown in front view and includes mounted on the front windshield 82 a sign 84 produced according to the present invention. The sign 84 would most conveniently be placed in the upper portion of the windshield 82 in the area of the rear view mirror 86. A large area in front of the rear view mirror is an unused part of the windshield. This "free" windshield area forward of the rear view mirror is about six inches by ten inches in almost all vehicles, or about 60 square inches, or about 4% of the windshield area. The windshield of a medium-sized automobile has an area of about 1,500 square inches. Therefore, a 3.5 inch disc, such as sign 84 in FIG. 7, would occupy 9.6 square inches, or only 0.64% of the windshield area, and could be safely and legally applied to a vehicle windshield. A sign identical to sign 84 could also be applied to the automobile rear window in approximately the same location. A 3.5 inch disc would occupy only abouty 1.20% of the area of the rear window of a medium-sized autmobile.

Colorful, light-reflective and luminescent pressure-sensitive shapes that could be seen from afar, and placed at the top center of windshields as indicated by sign 84 in FIG. 7 and on rear automobile windows, as well, would aid in locating parked cars. Shopping centers, airports, stadiums, racetracks and mass transit parking areas, in particular, are places where people constantly encounter difficulty seeking their automobiles, a task made a bit more difficult by trends towards the standardization of automobile models and of colors. Such car finding helps could be made in a variety of colors, patterns and sizes. Placing them anywhere in the top portion of an automobile windshield would be legal, as discussed above, since they would occupy only a minimal area of the windshield. A three inch diameter disc, adhered to a vehicle, can be spotted at a considerable distance, particularly when colors such as international orange or fluorescent yellow or green are employed in the manufacture of the disc 84. The inherent utility of such a product will be immediately apparent to anyone who has ever wandered through a large, crowded parking lot of seemingly identical automobiles trying to locate the vehicle he knew he had parked somewhere in the vast lot.

The uppermost area of the front windshield is heavily tinted in most automobiles manufactured today and in recent years. Hence, for maximum visibility, any signal locator for an automobile must be positioned on the exterior, although interior mounting would be satisfactory on the rear window since few of those are ever tinted. Consequently, it is preferable to employ a material for the top sheet 62 of the laminate or a protective film which is tough and weather-resistant. A sign made according to the present invent and applied, like sign 84, to an exterior location on an automobile windshield as indicated in FIG. 7 has proved to be impervious to the action of both windshield wiper blades and cleaning products, most of which include ammonia, isopropyl alcohol, petroleum-based products and the like. Moreover, this sign has withstood repeated removals and reapplications over an extended period of time and continues to function effectively as an identifying signal. This is in distinct contrast to the pressure sensitive adhesive products currently available on the market.

Removable and reusable pressure sensitive markers and signals similar to the product mentioned above would be of use to funeral directors to keep cemetery-bound mourners together, particularly when there are a large number of vehicles in traffic, and the cemetery is at some distance from the church or funeral home. The provision of an adhesive-free zone within the marker or signal makes removal of the marker or signal quite easy so that it may be reused on subsequent occasions.

An additional use of the present invention would be in the office environment where signs, labels or tags made of paper or similar materials could be provided with an adhesive-free zone, the location of which is preferably indicated by the application of a marker, such as marker 18 in FIG. 1. Such signs could be used to mark files and the like.

Industrial Applicability

The present invention will find its primary applicability in the production of high quality, easily removable and reusable signs, labels, tags, markers and other information-conveying materials which are held on a surface or substrate by a layer of pressure-sensitive adhesive. The number of uses to which the readily removable sign of the present invention may be put is virtually limitless.

I claim:

1. A method for producing a readily removable pressure-sensitive adhesive sign including the steps of:

(a) providing a first sheet having at least one surface characterized by low adhesion;

(b) perforating said first sheet to form a plurality of perforations arranged in a predetermined pattern in said sheet, wherein each of said perforations has a predetermined configuration;

(c) providing a second sheet having a first, information-conveying surface and a second, adhesive-receiving surface opposite said first surface;

(d) applying a layer of pressure-sensitive adhesive to said second surface of said second sheet;

(e) laminating said first sheet to said second surface of said second sheet to form a laminate so that said perforations expose adhesive-containing zones on the first sheet side of said laminate;

(f) neutralizing the adhesive in said adhesive-containing zones to form adhesive-free zones; and (g) cutting said laminate to form a plurality of signs, each of said signs having an adhesive-free zone contained within the perimeter thereof.

2. The method described in claim 1, further including the step of applying a marker to said laminate to mark the location of each of said adhesive-free zones in each of said signs.

3. The method described in claim 1, further including, prior to step (g), the step of laminating a third sheet to the first, information-conveying surface of said second sheet.

4. The method described in claim 1, further including, prior to step (g), the step of applying information to said first, information-receiving surface of said second sheet.

5. The method described in claim 1, wherein said adhesive is neutralized by applying an adhesive-neutralizing material to each of said adhesive-containing zones.

6. The method described in claim 5, wherein said adhesive-neutralizing material is in the form of a powder.

7. The method described in claim 6, wherein said adhesive-neutralizing material is selected from the group consisting of magnesium silicate, charcoal and silica.

8. The method described in claim 7, wherein said adhesive-neutralizing material is magnesium silicate.

9. A label for removable application to a substrate including a first sheet having a first, information-conveying surface and a second, adhesive-receiving surface opposite said first surface, a layer of pressure-sensitive adhesive adjacent to and completely covering said second surface, at least one finger grip means on said second surface for grasping the edge of said label immediately interior of and adjacent to the perimeter of said label comprising a zone where the adhesive has been neutralized to render the zone nonadherent, marking means on said first surface for marking the location of said finger grip means, and a second backing sheet including a low adhesion portion in mating contact with said adhesive layer of said first sheet.

* * * * *